United States Patent [19]

Kreuter

[11] Patent Number: 4,682,574

[45] Date of Patent: Jul. 28, 1987

[54] ELECTROMAGNETICALLY-ACTUATED POSITIONING SYSTEM

[76] Inventor: Peter Kreuter, Josef-Ponten Str. 38, Aachen, Fed. Rep. of Germany

[21] Appl. No.: 850,937

[22] Filed: Apr. 11, 1986

[30] Foreign Application Priority Data

Apr. 12, 1985 [DE] Fed. Rep. of Germany ..... 3513107

[51] Int. Cl.[4] ..... F01L 9/04; H01F 7/08

[52] U.S. Cl. ..... 123/90.11; 251/129.1; 251/129.16; 335/262; 335/266

[58] Field of Search ..... 123/90.11; 251/129.09, 251/129.1, 129.16, 129.18; 335/256, 258, 262, 266, 268

[56] References Cited

U.S. PATENT DOCUMENTS 4,455,543 6/1984 Pischinger et al. ..... 335/266
4,544,986 10/1985 Buchl ..... 123/90.11 X
4,614,170 9/1986 Pischinger et al. ..... 123/90.11

FOREIGN PATENT DOCUMENTS 1121469 10/1984 U.S.S.R. ..... 123/90.11

*Primary Examiner*—Tony M. Argenbright
*Attorney, Agent, or Firm*—Jacques M. Dulin

[57] ABSTRACT

An electromagnetic positioning system in displacement machines such as internal combustion engines in which spring-loaded valve actuators are shifted between two operating positions. Upon startup, the locus of equilibrium of the spring system is shifted by means of an adjusting solenoid which moves one of the spring system supporting seat members. The support seat member for the spring system is secured to and guided by a sleeve which, upon startup, is guided along the actuator rod. When the device is in its operating position, the actuator rod is guided in the sleeve. The working surface of the adjusting solenoid core has a beveled surface which assists in centering the sleeve in its operating position. The invention is particularly applicable to lifting valves and sliding gate valves, e.g., intake and exhaust valve actuators.

8 Claims, 1 Drawing Figure

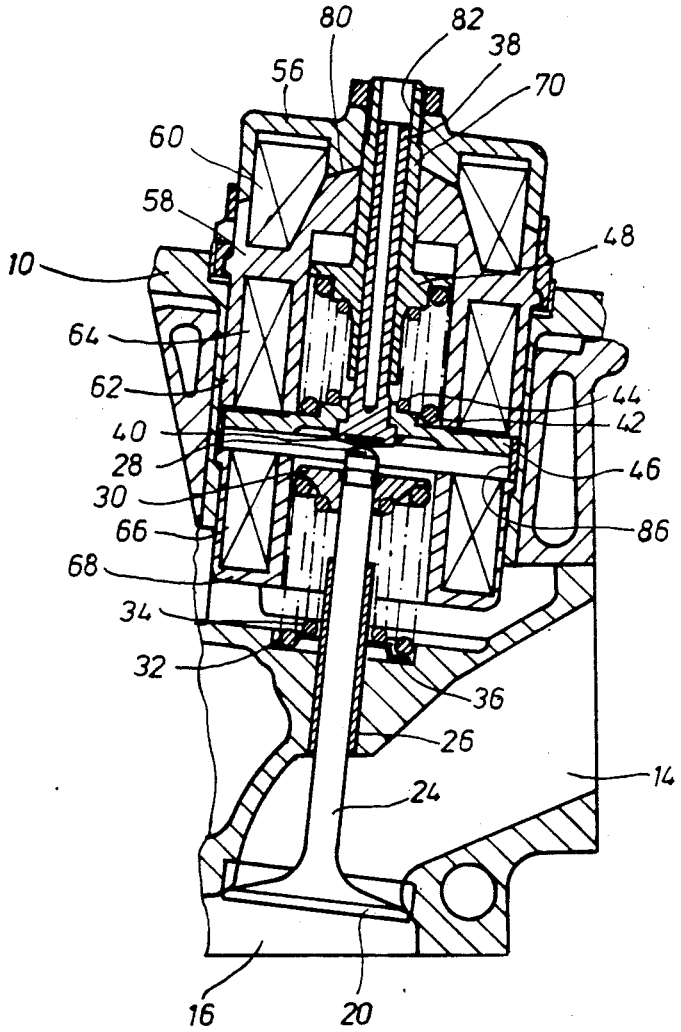
80
82
38
56
70
60
58
48
10
64
62
44
42
40
28
46
30
86
66
68
34
32
36
26
14
24
16
20

ELECTROMAGNETICALLY-ACTUATED POSITIONING SYSTEM

FIELD

The invention concerns an electromagnetically-actuated positioning system for spring-loaded reciprocating actuators in displacement machines, such as for lifting valves of internal combustion engines, having improved guide and centering systems for the actuator rods. The positioning mechanism has a spring system and two electrically-operated, opposed actuating solenoids, by means of which the actuator may be moved between, and held at, two discrete, mutually-opposite operating positions. The positioning mechanism also includes an adjusting solenoid which serves to shift the locus of the spring system equilibrium from a point centered between the operating positions, to a non-central point by shifting a support acting as one seat for the spring system. The improved guide and centering system is characterized by having an elongated sleeve with an internal bore which carries the actuator rod, which sleeve is secured to the spring support seat member. The working surface of the adjusting solenoid core has a beveled surface which assists in centering the sleeve in its operating position.

BACKGROUND

A comparable positioning system is known from the DE-OS No. 30 24 109.

The system therein described has a single valve stem, one end of which is connected to the valve disk of an internal combustion engine, while the other end carries an anchor plate capable of reciprocating travel between two solenoids. An adjusting solenoid is provided to guide the locus of equilibrium of the spring system to an operational position upon startup, and to achieve this a support forming the seat of the spring system must be shifted. Insofar as the stem is also guided by the support, it is important that no tilting take place during support movement, so that, when the support has arrived at its operating position, stem guidance is as friction-free as possible.

However, in the normal operating RPM range of modern engines, the valve actuators must change positions frequently, at precise intervals, and their stroke must be the full length of intended travel. At the high temperatures and frequency of movement, friction due to even slight misalignment of tappets and/or actuators can delay properly timed valve opening and closing, reduce opening, or hinder complete closing, thereby causing reduced engine performance. There is thus a significant need for improved valve actuator guide and centering mechanisms.

THE INVENTION

Objects

It is among the objects of the invention to provide a mechanism in which operational problems caused by tilting of the spring system support during its travel from the rest position to the operating position are avoided.

It is another object of this invention to provide an improved valve actuator guide and centering system.

It is another object of the invention to provide an improved system for guiding and centering actuator rods of spring-loaded reciprocating actuator assemblies in displacement machines, such as are used in conjuction with lifting valves of internal combustion engines.

It is another object of the invention to provide improved guiding and centering mechanisms for adjusting-solenoid moveable spring support seat members of spring systems in electromagnetically-actuated spring system equilibrium adjusting mechanisms in displacement machines.

It is another object of the invention to provide improved adjusting solenoid mechanisms which are specially adapted with a working surface which assists in centering the sleeve for the spring support seat member and the actuator rod in actuator positioning mechanisms of displacement engines, particularly as used with valves in internal combustion engines.

It is another object of the invention to provide an improved guide system for a ferromagnetic anchor plate of an actuator assembly in an electromagnetically-actuated positioning mechanism of a displacement machine.

Still other objects will be evident from the following specification, drawing and claims.

THE DRAWING

The FIGURE is a side view, partly in section, showing the improved guide and centering system of the invention as adapted to use in conjunction with an exhaust valve actuator assembly of an internal combustion engine.

SUMMARY

The objects of the invention are achieved by providing an improved guide and centering system for an electromagnetically-actuated positioning mechanism for spring-loaded valve actuator assemblies in displacement machines, such as are used with lifting valves of internal combustion engines. The overall positioning mechanism has a spring system and two electrically-operated, opposed actuating solenoids. By alternate energizing of the solenoids, the actuator assembly may be moved between, and held for a predetermined desired length of time at two discrete, mutually-opposite operating positions, e.g., valve open and valve closed positions. The positioning mechanism also includes an adjusting solenoid which serves to shift the locus of the spring system equilibrium from a point centered between operating positions to a non-central point. This is accomplished by the adjusting solenoid shifting a support which acts as one seat of the spring system.

The improved guide and centering system of the invention comprises an elongated tubular sleeve secured to a spring support member within which is reciprocably received the rod of the acutator assembly. The sleeve and support are secured to the ferromagnetic anchor plate of the adjusting solenoid. The sleeve is received and moves in a central bore in the adjusting solenoid core, and the support is received and moves in a larger, coaxial bore in the actuating solenoid core. In operation, first the rod, which is temporarily fixed by energizing one of the actuating solenoids, guides the sleeve to advance into its operating position during adjustment of the spring support seat. This prevents tilting of the seat. Then the rod is guided by the sleeve as it moves in response to attraction of the actuator assembly's ferromagnetic anchor plate by the other actuating solenoid. This helps prevent the actuator assembly anchor plate from tilting and binding during its travel.

Pursuant to the invention, the support has an integral sleeve for the actuator rod, and the sleeve, guided along the rod, is able to arrive at its exact operating position.

In a preferred embodiment, the adjusting solenoid anchor plate (which like the spring support is secured to the sleeve) has bevels which, in the operating position, act with mating bevels on the solenoid core to automatically center the support.

The invention further concerns a procedure for startup of the positioning device. In this case, an anchor plate is connected to the actuator rod and travels in a guideway. The actuator assembly thus comprises an actuator rod having at one end an anchor plate and a tappet which contacts the end of the valve stem. Upon startup, the adjusting solenoid anchor plate and the sleeve ensure that the support is shifted to the required operating position.

When the spring support has reached its required operating position, the sleeve acts to guide the actuator rod and thereby the actuator assembly anchor plate, thus permitting precisely-aligned anchor plate operation.

Pursuant to the invention, this procedure is essentially characterized by the fact that the actuator assembly anchor plate and the rod first act together to guide the support and its sleeve. Following support centering, the support and its sleeve act to guide the actuator assembly rod and the anchor plate.

DETAILED DESCRIPTION OF THE BEST MODE OF THE INVENTION

The following detailed description of the best mode of carrying out the invention is by way of example and not by way of limitation of the principles of the invention.

The FIGURE shows a sample implementation of the invention. Item 10 identifies the cylinder head of the engine block of an internal combustion engine. Cylinder bore 16 is exhausted by an exhaust valve: lifting of valve disk 20 opens exhaust port 14. The valve is controlled by an electromagnetically-actuated positioning system.

Valve disk 20 is integral with valve stem 24 which slides in valve guide 26, inserted in cylinder head 10. The end of valve stem 24, indicated as Item 28, has a bearing surface which contacts a tappet 40, to be described below. A flange 30 is circumferentially mounted on the end of valve stem 24 opposite valve disk 20. Flange 30 acts as a seat for a spring system consisting of a large spiral spring 32 and a small spiral spring 34. Both spiral springs 32 and 34 are coaxially installed. The opposite spring seat 36 is formed by a bearing surface in the cylinder head. Valve stem 24 may be actuated in valve guide 26 against the loading of springs 32 and 34, causing valve disk 20 to rise off its seat and open exhaust port 14.

An axial extension to valve stem 24 is formed by actuator rod 38, the lower end of which is fitted with tappet 40, which makes contact with valve stem 26. An annular anchor plate 46, made of ferromagnetic material, is fastened to actuator rod 38 in the region of tappet 40. This anchor plate also supports a spring system consisting of a large spiral spring 42 and small spiral spring 44, which are also coaxial to one another and to rod 38.

The opposite seat for this spring-loading system 42 and 44 is formed by support 48, to be described in greater detail below.

A magnet core 68 having a U-shaped cross-section is annularly installed, the axis of the annulus coinciding with the axis of valve stem 24. A coil 66 is situated inside magnet core 68. The open side of U-sectioned magnet core 68 faces in the direction of anchor plate 46.

Actuator rod 38 is likewise surrounded by a similarly-shaped magnet core 62, inside of which is a coil 64. Depending on excitation of solenoids 62 and 66, anchor plate 46 moves from a contact face on magnet core 64 to a contact face on magnet core 68, and back.

Also provided is a adjusting solenoid consisting of a magnet core 58 and a coil 60. Energizing coil 60 attracts ferromagnetic component 56, which is joined to sleeve 70. The working surface of magnet core 58 forms a bevel defining a sort of conical housing, as magnet core 58 annularly surrounds actuator rod 38. Ferromagnetic component 56 is likewise provided with a bevel 80 such that, when it is attracted by magnet core 58, bevel 80 mates snugly with the bevel of magnet core 58, automatically centering ferromagnetic component 56 in the attracted position. Sleeve 70, in which actuator rod 38 is guided, is attached to ferromagnetic component 56. Sleeve 70 contains an internal bore 82 through which rod 38 can slide back and forth.

Upon energizing coil 60, ferromagnetic component 56 is attracted and centers itself by means of its bevel 80, so that sleeve 70 moves downward, thereby shifting support 48, which provides the seat for spring system 42 and 44.

Upon startup of the device pursuant to the invention, actuating solenoid 64 is frst energized and moves the actuator to one of its operating positions (preferably the closed position). Actuator 38 is thus in a defined position, and subsequent excitation of adjusting solenoid 60 shifts the locus of equilibrium of spring system 42 and 44 from an eccentric position between solenoids 62 and 66 to a central position between the actuating solenoids, such that the subsequent movement of actuator 38 will be symmetrical between solenoids 62 and 66.

An important aspect of the above is that anchor plate 46 is held fast by solenoid 62 during the energizing of adjusting solenoid 60, and is thus relatively rigid. Being thus fixed, actuator rod 38, mounted in bore 82, thereby acts to guide sleeve 70 such that, following complete travel of the ferromagnetic component 56, bore 82 is precisely aligned in its operating position. At this moment, bevels 80 assume the task of precise centering.

In subsequent operating movement, bore 82 acts to precisely guide actuator rod 38, while the edge of anchor plate 46 is also guided by guideway 86 during the plate's reciprocating movement. Anchor plate tilt is now prevented by sleeve 70, while prior to startup, tilting of sleeve 70 has been prevented by fixed anchor plate 46 and rod 38.

It should be understood that various modifications within the scope of this invention can be made by one of ordinary skill in the art without departing from the spirit thereof. I therefore wish my invention to be defined by the scope of the appended claims as broadly as the prior art will permit, and in view of this specification if need be.

What is claimed:

1. An improved guide and centering system for an electromagnetically-actuated positioning mechanism of spring-loaded valve-type reciprocating actuators in displacement machines, comprising in operative combination:

(a) means for reciprocatingly actuating a valve member, said reciprocating actuator means being movable between two discrete, mutually-opposite operating positions;

(b) said reciprocating actuator means comprising a rod member having an electromagnetically attractable anchor plate member secured adjacent one end thereof, said actuator means being disposed to permit said valve member to move from a first, closed operating position to a second, open operating position;

(c) said reciprocating actuator means being biased toward said second open position by at least one spring member having opposed ends;

(d) one end of said spring being receivingly engaged by a support member acting as one seat for said spring member;

(e) means for adjusting the position of said spring support member, said adjusting means comprising a tubular sleeve member having said support member mounted medially thereof; and (f) said sleeve member being adapted to reciprocatingly receive said actuator rod member so that as said spring position is adjusted, said rod guides said sleeve, and as said actuator means actuates said valve member said sleeve guides said rod.

2. An improved guide and centering system as in claim 1 wherein:

(a) said adjusting means includes an electromagnet having a core member and a coil, and a ferromagnetically attractable anchor plate member;

(b) said adjusting means anchor plate is secured to said sleeve spaced from said support member;

(c) said adjusting means anchor plate includes at least one beveled surface adapted to co-act with at least one beveled surface on said core member to automatically center said support-carrying sleeve when said adjusting means electromagnet is energized.

3. An improved guide and centering system as in claim 2 which includes:

(a) a pair of spaced-apart electromagnets disposed to selectively attract said actuator anchor plate to said first or said second operating position when energized;

(b) said actuator anchor plate being disposed between said electromagnets; and (c) a guideway disposed between said electromagnets adapted to guide said actuator anchor plate in its movement from one position to another.

4. An improved guide and centering system as in claim 3 which includes:

(a) said valve member is biased toward said first, closed position by at least one spring member;

(b) said valve and said actuator spring members forming a spring system having a locus of equilibrium situated between said two operating positions; and (c) said adjusting means is adapted to shift the locus of equilibrium of said spring system to a position different from either of said operating positions.

5. An improved guide and centering system as in claim 1 wherein:

(a) said system is disposed in association with at least one gas exchange valve in an internal combustion engine.

6. An improved guide and centering system as in claim 2 wherein:

(a) said mechanism is disposed in association with at least one gas exchange valve in an internal combustion engine.

7. An improved guide and centering system as in claim 3 wherein:

(a) said mechanism is disposed in association with at least one gas exchange valve in an internal combustion engine.

8. An improved guide and centering system as in claim 4 wherein:

(a) said mechanism is disposed in association with at least one gas exchange valve in an internal combustion engine.

* * * * *